US005724710A

United States Patent [19]

Hancock

[11] Patent Number: 5,724,710

[45] Date of Patent: Mar. 10, 1998

[54] FASTENER FOR SECURING AN OBJECT

[76] Inventor: Michael T. Hancock, 334-1/2 E. 10th St., Azusa, Calif. 91702

[21] Appl. No.: 422,798

[22] Filed: Apr. 17, 1995

[51] Int. Cl.[6] ..... A43C 7/06

[52] U.S. Cl. ..... 24/712.7; 24/129 D

[58] Field of Search ..... 24/115 R, 115 G, 24/115 H, 129 R, 129 D, 129 A, 712, 712.1, 712.2, 712.7, 712.5; 2/336

[56] References Cited

U.S. PATENT DOCUMENTS

| | | | |
|---|---|---|---|
| 849,921 | 4/1907 | Schelling | 24/712.5 |
| 1,442,531 | 1/1923 | Mather et al. | 24/129 D |
| 1,907,629 | 5/1933 | Walty | 24/129 D |
| 2,107,692 | 2/1938 | De Botelho . | |
| 2,632,219 | 3/1953 | Massey | 24/115 R |
| 2,636,237 | 4/1953 | Price | 24/712.7 X |
| 3,430,754 | 3/1969 | Meseke et al. . | |
| 4,059,866 | 11/1977 | Rohland . | |
| 4,545,138 | 10/1985 | Blum | 24/712.2 |
| 5,144,696 | 9/1992 | Kahl | 2/336 X |
| 5,182,838 | 2/1993 | Stenner | 24/712.7 |

FOREIGN PATENT DOCUMENTS

| | | | |
|---|---|---|---|
| 1449898 | 8/1966 | France | 24/129 D |

*Primary Examiner*—James R. Brittain

*Attorney, Agent, or Firm*—Boniard I. Brown

[57] ABSTRACT

A fastener for securing an object is formed of a resilient material and includes an opening therethrough. At least two lines, such as a shoestring, cord, rope, twine, siring, or similar article, extending from the object are disposed through the opening in substantially the same direction. By pulling on respective ends of the line in opposite directions, the fastener is distorted for providing a gripping action between the fastener and the lines. In one embodiment, the fastener is an annular member having the lines wrapped at least once around a wall of the fastener. As the ends of the line are pulled, the annular member twists and rolls into a shape having at least one loop, such as a figure eight type shape. In another embodiment, the fastener is a tubular member. As the ends of the line are pulled, one open end of the tubular member rolls toward an opposite open end of the tubular member. The plastic deformation or torsion of the fastener provides a gripping action between the lines and the fastener, securing the ends of the line together without the need to tie the ends of the line together.

11 Claims, 2 Drawing Sheets

FASTENER FOR SECURING AN OBJECT

BACKGROUND OF THE INVENTION

The present invention relates to the securing together of articles and, more particularly, to fasteners and a method for securing together lines extending from articles or objects being secured.

In the prior art, the securing or locking of lines extending from objects or bundles to be secured, typically involve tying the lines together, as by tying a single or double knot or by tying a single knot and then tying a bow knot. Such tying processes consume time, am tedious, and are often difficult for persons such as persons with arthritis or other ailments, and young children. Further, such knots may become loosened and disengaged, thus creating problems such as the falling or dropping of objects, the tripping of a person on loose shoelaces, etc. A fastener for securing shoe laces is disclosed in U.S. Pat. No. 1,907,629 issued May 9, 1933 to Walty and entitled "Lace Fastener". The lace fastener includes an opening into which the laces are disposed in opposite directions. However, this device requires the single knot and bow knot to be tied around the lace fastener.

Therefore, a need exists for an apparatus and method for securing together the lines extending from an object which does not require the tying of knots and which prevents the loosening of the lines during use of the object.

SUMMARY OF THE INVENTION

An apparatus for securing at least one object includes at least two lines extending from at least one object to be secured and a fastener defining an opening therethrough for receiving the lines and formed of a resilient material. The fastener is adapted to deform when subjected to stresses produced by the pulling of the lines extended through the opening in opposite directions from the fastener, whereby the fastener is deformed into a configuration defining at least one loop to provide a gripping action between the fastener and the lines produced by fastener distortion and friction between the lines and the fastener.

The fastener may be adapted to twist, distort, and roll when subjected to torsional stresses produced by the pulling of the lines in opposite directions from the fastener, or alternatively, the fastener having a first open end and a second open end, may be adapted to deform and roll when subjected to the pulling of the lines in opposite directions, whereby one of the open ends of the fastener is rolled toward an opposite open end of the fastener for providing the gripping action.

A method of securing together lines extending from at least one object to be secured, includes the steps of providing a fastener having an opening therethrough and being formed of a resilient material and adapted to distort under pressure. The lines are extended through the opening in the fastener. Pulling in opposite directions on respective ones of the lines applies pressure to the fastener to effect distortion of the fastener about the lines, whereby the lines are gripped and secured together, the securing and gripping action being provided by the fastener resilient material exerting clamping action on the lines.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention described herein provides an apparatus and method for securing at least two lines together.

An annular or tubular member is disposed about at least a pair of lines extending from or about an object, such as laces extending from a shoe or boot, lines extending from a package, a gathering of items, or the like. An elastic deformation of the annular or tubular member by the pulling on the lines or articles provides the securement of the articles together, without the need to tie the articles together.

Figure 1:
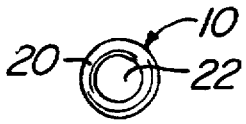
FIG. 1 is an illustration of a fastener.
Figure 2:
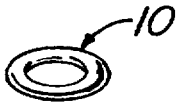
FIG. 2 is an illustration of the fastener in a perspective view.

Referring to FIGS. 1 and 2, a fastener 10 includes a resilient member constructed of a material, such as plastic, rubber, polypropylene, or the like. The fastener 10 is an annular member having a wall 20 with an outside diameter and an inside diameter. The inside diameter defines an opening 22 therethrough sized and adapted to receive at least two lines or articles, such as strings, cords, ropes, or the like.

Figure 3:
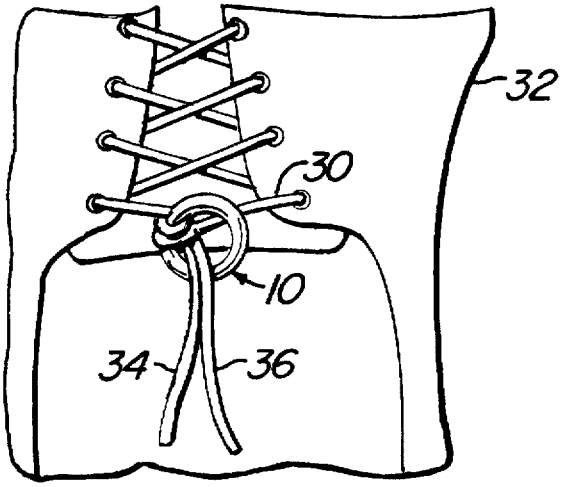
FIG. 3 is an illustration of the fastener disposed on a shoestring of a shoe.

Referring to FIG. 3, as an example, the lines may be a shoestring 30 positioned within eyelets of a shoe 32. The shoestring 30 has a first end 34 and a second end 36 disposed within the opening 22 of the fastener 10 in substantially the same direction and wrapped at least once around the wall 20.

Figure 4:
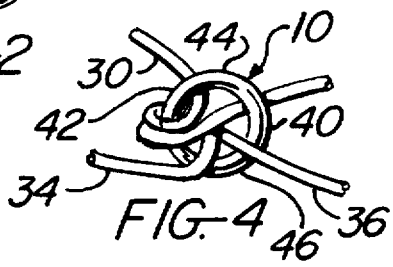
FIG. 4 is an illustration of the fastener as each end of the shoestring is pulled outwardly.

Referring to FIGS. 3–7, to secure the shoe 32, a person grasps the first end 34 and the second end 36 of the shoestring 30 in each hand and pulls the shoestrings outwardly, as illustrated in FIG. 4. The substantially equal and opposite force applied to each shoestring end 34 and 36 causes the fastener 10 to contort, twist and bend. As the shoestrings 30 are pulled, the shoestrings 30 contact points 40 and 42 of the wall 20, and rolls the fastener 10 about its annular axis. As the points 40 and 42 roll, the remaining portions of the wall 20, such as sides 44 and 46, twist creating the torsion of the fastener 10.

Figure 5:
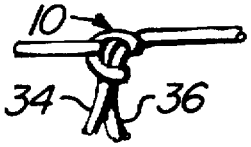
FIG. 5 is a front view of the fastener contorted into a figure eight shape.
Figure 6:
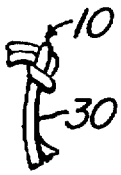
FIG. 6 is a side view of the fastener in the figure eight shape of FIG. 5.
Figure 7:
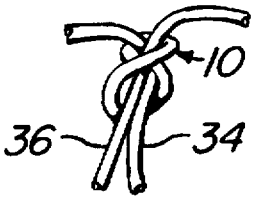
FIG. 7 is a back view of the fastener in the figure eight shape of FIG. 5.

As an example of the torsion of the fastener 10, FIGS. 5–7 illustrate the contortion of the annular ring shaped fastener 10 into a figure eight shaped fastener 10, having at least one loop. Depending on the number of times that the lines are wrapped around the fastener 10 and the pressure applied to the lines, the fastener 10 may be contorted into additional bends or twisting of the wall 20. As an example, the fastener 10 may be contorted into two, three or more loops for providing a stronger securement of the shoestring 30. The figure eight type shape illustrated is only one example of the type of shape which may result from the torsion. Depending on the positioning of the lines within the opening 22 and around the wall 20, the force may create various shapes of the fastener 10 for providing the gripping action.

The torsion of the fastener 10 causes the fastener 10 to be intertwined with the shoestring 30, gripping the shoestring 30 for securing together the first and second ends 34 and 36 of the shoestring 30. The securement of the shoestring 30 is also provided by friction between the first and second ends 34 and 36 of the shoestring 30, friction between the shoestring 30 and the fastener 10 material, the resilient material of the fastener 10 clamping on the shoestring 30, the shoestring 30 bending through the loops of the fastener 10, and the shoestring 30 material expanding in the gaps provided between the loops of the fastener 10.

For the various embodiments of this invention, the same reference characters will be used to designate like parts: In addition, like functions and like interactions of the parts among the various embodiments of this invention will not be repeated for each embodiment.

Figure 8:
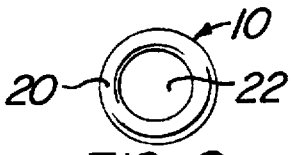
FIG. 8 is an illustration of an alternative embodiment of the fastener having an enlarged inside diameter.
Figure 9:
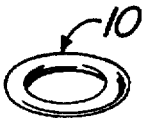
FIG. 9 is an illustration of the fastener in a perspective view.
Figure 10:
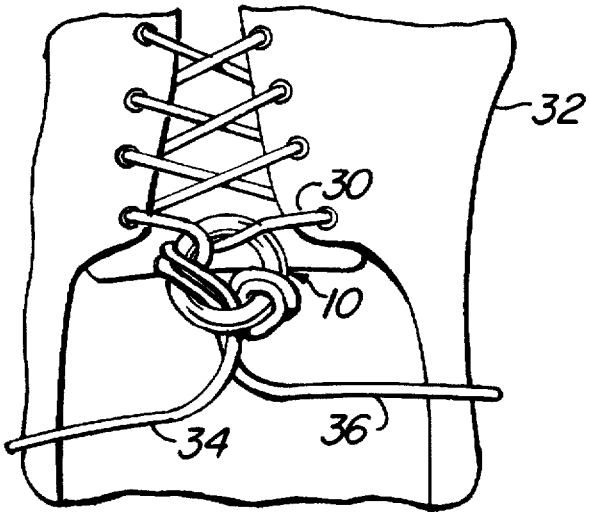
FIG. 10 is an illustration of the fastener disposed on the shoestring of the shoe.
Figure 11:
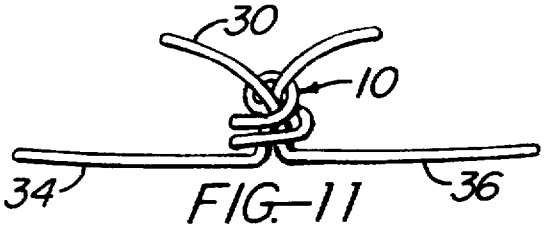
FIG. 11 is a front view of the fastener contorted into a double loop shape.
Figure 12:
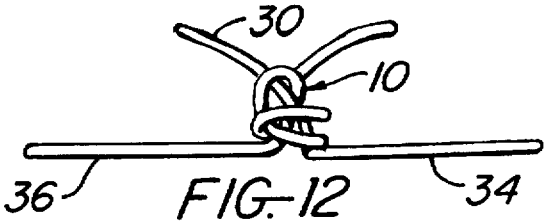
FIG. 12 is a back view of the fastener in the double loop shape of FIG. 11.
Figure 13:
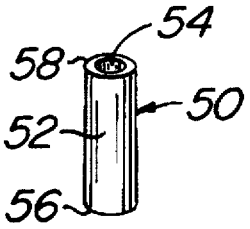
FIG. 13 is an illustration of another alternative embodiment of the fastener.
Figure 15:
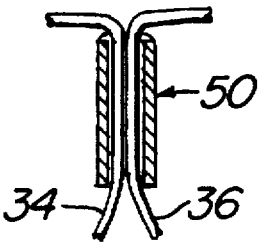
FIG. 15 is a partial sectional view of the fastener disposed on the shoestring.

Referring to FIGS. 8–10, in addition to functioning similarly to the embodiment illustrated in FIG. 1, the fastener 10 has an inside diameter sized to enable the ends 34 and 36 of the shoestring 30 to be wrapped around the wall 20 at least twice. As the shoestrings 30 are forced outwardly, the fastener 10 distorts. Continual pressure applied to the shoestrings 30 causes the shoestrings 30 to deform the fastener 10 into a figure eight type shape, and then into a double loop type shape, as illustrated in FIGS. 11–12. As an example, in the double loop shape, the figure eight shape may be positioned inside of the outer loop.

Referring to FIGS. 13–20 and using the same reference characters to define like parts, an alternative embodiment of the fastener 10 as illustrated in FIGS. 1–12 may be a fastener 50. The fastener 50 is a resilient member constructed of a material, such as plastic, rubber, polypropylene, or the like. The fastener 50 is a tubular member having a wall 52 with an outside diameter and an inside diameter. The inside diameter defines an opening 54 therethrough sized and adapted to receive at least two lines. The wall 52 extends between a first open end 56 and a second open end 58.

Figure 14:
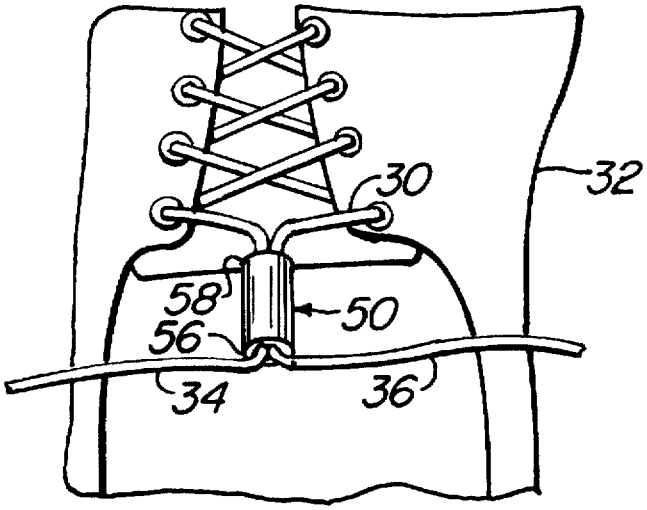
FIG. 14 is an illustration of the fastener disposed on the shoestring of the shoe.

Referring to FIG. 14, the first end 34 and second end 36 of the shoestring 30 of the shoe 32 are disposed within the opening 54 of the fastener 50 in substantially the same direction.

Figure 16:
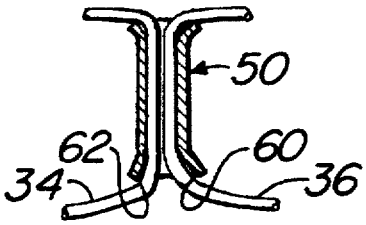
FIG. 16 is a partial sectional view of the fastener as each end of the shoestring is pulled outwardly.
Figure 17:
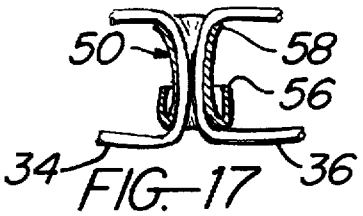
FIG. 17 is a partial sectional view of the fastener disposed on the shoestring having a first open end of the fastener rolled toward a second open end of the fastener.
Figure 19:
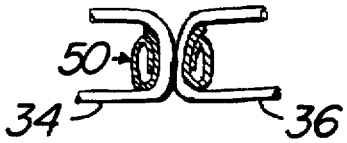
FIG. 19 is a partial sectional view of the fastener contorted into a plurality of folds.
Figure 18:
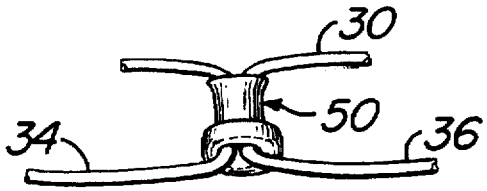
FIG. 18 is a schematic illustration of the fastener of FIG. 17.
Figure 20:
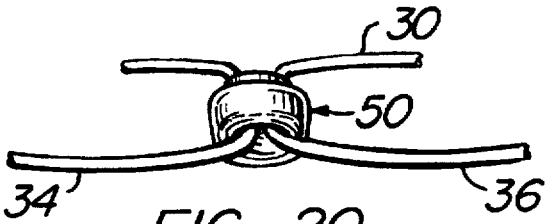
FIG. 20 is a schematic illustration of the fastener of FIG. 19.

Referring to FIGS. 15–20, to secure the shoe 32, a person grasps each end 34 and 36 of the shoestring 30 in each hand and pulls the ends 34 and 36 outwardly, as illustrated in FIGS. 14 and 16, causing the first and second ends 56 and 58 of the wall 52 to expand, as illustrated in FIG. 16. As the ends 34 and 36 of the shoestring 30 are pulled, the pressure exerted by the shoestrings 30 causes the shoestrings 30 to contact points 60 and 62 of the wall 52, and rolls one end, such as the first open end 56, of the fastener 50 towards the opposite end of the fastener 50, such as the second open end 58, as illustrated in FIGS. 17 and 18. As pressure continues to be exerted on the fastener 50 by pulling the shoestrings 30, the first open end 56 continues to roll toward the second open end 58, as illustrated in FIGS. 19 and 20. The rolling or folding of the fastener 50 reduces the space between the inside diameter of the fastener 50 and the shoestring 30, securing the first and second ends 34 and 36 of the shoestring 30 together.

The tighter that the shoestrings 30 are pulled, the tighter the grip of the fastener 50 on the shoestrings 30. The rolling action produces at least one loop, such as a fold or overlap of one open end toward the other open end of the fastener 50. Preferably, the rolling action produces a plurality of folds for tightening the grip of the shoestrings 30 within the fastener 50. The tubular fastener 50 is contorted by stretching and twisting to effect the gripping action. Friction between the tubular fastener 50 and the shoestring 30, the resilience of the tubular fastener 50, and the resilience of the shoestrings 30 upon being rolled up and tightened, provides an effective gripping action. The compression of the resilient lines or shoestrings 30 exerts additional gripping action.

For the fasteners 10 and 50, to loosen the shoestrings 30, the first end 34 of the shoestring 30 is pulled alternately with the second end 36 of the shoestring 30. By pulling only one end of the shoestring 30 at a time, the fastener 10 or 50 is forced to progress or slide away from the shoe 32 along the shoestring 30, loosening the shoe 32. As the fastener 10 or 50 moves along the shoestring 30, the contortion of the fastener 10 or 50 relaxes and the fastener 10 or 50 may resume its original shape. Alternatively, if the fastener 10 or 50 does not resume its original form, a person's hand may be positioned between the shoe 32 and the fastener 10 or 50 to manipulate the fastener 10 or 50.

An advantage of the use of the fasteners 10 and 50 is to prevent shoestrings from becoming untied or loosened. The fasteners 10 and 50 provide a fast and easy method of securing shoestrings together. Preferably, shorter shoestrings should be used to avoid tripping on the ends of the shoestrings.

Other uses of the fasteners 10 and 50 may be to bundle items together, such as tree branches, to secure the drawstrings for bags, containers, or the like, to moor a boat, to use as a tourniquet, or the like. The fasteners 10 and 50 do not abrade or wear the material of the shoestrings, ties, locking grip, or the like.

Therefore, the invention provides an apparatus and method for securing together a pair of lines extending from or about an object.

I claim:

1. An apparatus for securing at least one object, comprising:

a fastener of resilient material defining an opening therethrough for receiving said lines at least two lines extending from said at least one object to be secured and through said fastener opening, and at least two lines extending from said at least one object to be secured and through said fastener opening, and said fastener being deformed by stresses produced by the pulling of said lines extended through said opening in opposite directions from said fastener to apply pressure to the fastener to distort and roll the fastener into a configuration defining at least one loop to provide a gripping action between said fastener and said lines produced by fastener distortion and friction between said lines and said fastener.

2. The apparatus according to claim 1, wherein said fastener is deformed and twisted under torsional stresses from pulling the lines in opposite directions from the fastener to twist, distort and roll the fastener into said configuration defining at least one loop to provide said gripping action, and to intertwine the fastener loop and the lines.

3. The apparatus according to claim 2, wherein said fastener is annular and has a wall defining said opening.

4. The apparatus according to claim 1, wherein said fastener is tubular and has first and second open ends and is deformed and rolled under stresses produced by the pulling of said lines in opposite directions from said fastener to roll one of said first and second open ends of said fastener toward the other of the open ends.

5. The apparatus according to claim 4, wherein said tubular fastener comprises a wall extending between said first open end and said second open end of the fastener.

6. The apparatus according to claim 1, wherein said lines are shoestrings extending from a shoe.

7. An apparatus for securing at least one object, comprising:

at least two lines extending from said at least one object to be secured, an annular fastener having a wall defining an opening therethrough for receiving said lines and formed of a resilient material, said lines being disposed through said opening and wrapped about said wall at least once for providing torsion of said fastener, said lines being disposed through said opening and wrapped about said wall at least once to provide torsion of said fastener, and said fastener being adapted to deform and twist when subjected to torsional stresses produced by the pulling of said lines extended through said opening in opposite directions from said fastener, whereby said fastener is twisted, distorted, and rolled into a configuration defining at least one loop to provide a gripping action between said fastener and said lines produced by fastener distortion and friction between said lines and said fastener.

8. An apparatus for securing at least one object, comprising:

at least two lines extending from said at least one object to be secured, an annular fastener having a wall defining an opening therethrough for receiving said lines and formed of a resilient material, said lines being disposed through said opening and wrapped about said wall at least once to provide torsion of said fastener, and said fastener being adapted to deform and twist when subjected to torsional stresses produced by the pulling of said lines extended through said opening in opposite directions from said fastener, whereby said fastener is twisted, distorted, and rolled into a configuration defining at least one loop to provide a gripping action between said fastener and said lines produced fastener distortion and friction between said lines and said fastener.

9. An apparatus for securing at least one object, comprising:

at least two lines extending from said at least one object to be secured, an annular fastener having wall means defining an opening therethrough receiving said lines and formed of a resilient material, said lines extending through said opening and wrapped about said wall means at least once for providing torsion of said fastener, and said fastener being deformed and twisted under torsional stresses produced by the pulling of the lines in opposite directions from said fastener to twist, distort, roll and configure the fastener to define at least one loop to provide a gripping action between the fastener and the lines.

10. An apparatus for securing at least one object, comprising:

at least two lines extending from said at least one object to be secured, a fastener defining an opening therethrough for receiving said lines and formed of a resilient material, and said fastener being deformed and twisted under torsional stresses produced by the pulling of said lines extended through said openings in opposite directions from said fastener, to twist, distort, and roll to provide a configuration defining at least one loop to provide a gripping action between said fastener and said lines produced by fastener distortion and friction between said lines and said fastener.

11. An apparatus for securing at least one object, comprising:

at least two lines extending from said at least one object to be secured, a resilient annular fastener having a wall surface defining an opening therethrough, said lines being disposed through said opening and wrapped about said wall surface at least once to exert torsion on the fastener, and said fastener being deformed and twisted under torsional stresses produced by the pulling of said lines extended through said opening in opposite directions from said fastener, whereby said fastener is twisted, distorted and rolled into a configuration defining at least one loop to provide a gripping action between said fastener and said lines produced by fastener distortion and friction between said lines and said fastener.

* * * * *